US005164559A

United States Patent [19]

Pham et al.

[11] Patent Number: 5,164,559

[45] Date of Patent: Nov. 17, 1992

[54] CIRCUIT BREAKER WITH AN INCORPORATED VARISTOR

[75] Inventors: Van Doan Pham; Edmond Thuries; Joseph Martin, all of Meyzieu, France

[73] Assignee: GEC Alsthom SA, Paris, France

[21] Appl. No.: 692,421

[22] Filed: Apr. 29, 1991

[30] Foreign Application Priority Data

Jun. 14, 1990 [FR] France ..... 90 07425

[51] Int. Cl.[5] ..... H01H 33/16

[52] U.S. Cl. ..... 200/144 AP; 200/148 A

[58] Field of Search ..... 200/144 AP, 146 R, 147 R, 200/148 A, 148 R

[56] References Cited

U.S. PATENT DOCUMENTS 3,912,974 10/1975 Hill ..... 361/11
4,204,101 5/1980 Dethlefsen ..... 200/144 AP
4,293,749 10/1981 Kishi et al. ..... 200/144 AP
4,338,500 7/1982 Pham Van et al. ..... 200/144 AP
4,421,962 12/1983 Thuries et al. ..... 200/144 AP
4,439,651 3/1984 Thuries et al. ..... 200/144 AP
4,608,470 8/1986 Bischofberger et al. .... 200/144 AP
4,831,487 5/1989 Ruoss ..... 361/111

FOREIGN PATENT DOCUMENTS 0157922 10/1985 European Pat. Off. .
2506067 11/1982 France .
2612683 9/1988 France .

*Primary Examiner*—J. R. Scott
*Attorney, Agent, or Firm*—Sughrue, Mion, Zinn, Macpeak & Seas

[57] ABSTRACT

An $SF_6$ circuit breaker having a varistor incorporated in line with its interrupting chamber in which insertion of the varistor on opening and closing is performed by coaxial translation of two electrodes outside and around the main contacts.

7 Claims, 2 Drawing Sheets

CIRCUIT BREAKER WITH AN INCORPORATED VARISTOR

The present invention relates to a high tension circuit breaker fitted with varistors to limit surge on interruption.

BACKGROUND OF THE INVENTION

The lower the operating threshold of a varistor, the more effective the protection it provides against surge. To obtain a low varistor operating threshold, only a small number of varistor components should be associated in series. Unfortunately the energy absorbed by each varistor component is then high.

The limiting surge value against which protection can be provided by varistors is currently 1.6 p.u. (where 1 p.u.=($\sqrt{2}/\sqrt{3}$) Un in peak value, where Un is the nominal phase voltage).

To limit surge below 1.6 p.u., while conserving acceptable energy dissipation in the varistor, proposals have been made, in particular in French patent application No. 90 02416, to insert the varistor by means of a delay system and a flexible drive member.

In French patent application No. 89 14433, proposals have been made to use a system having a compression spring and a traction spring.

These systems provide satisfaction, but they are relatively complex and expensive.

Non-published French patent application No. 79 08039 describes a compressed air circuit breaker including a system for inserting a resistor during interruption, in which the insertion electrode lies on the path of the arc. Attempts have been made to adopt this technique to inserting varistors, however the fact that the insertion electrodes are placed on the path of the arc means that they wear quickly, thereby increasing maintenance costs.

An object of the present invention is to provide a circuit breaker fitted with a device for inserting a varistor during a circuit breaker opening operation, which device is simple, reliable, cheap, and in particular does not include a delay system, nor any complex moving parts, nor an insertion electrode placed on the part of the arc.

SUMMARY OF THE INVENTION

The present invention provides a high tension circuit breaker insulated by gas having good dielectric properties, the circuit breaker comprising at least one interrupting chamber per phase, each chamber comprising a fixed main contact connected to a first current terminal and a moving main contact in electrical connection with a second current terminal and constituting a portion of moving equipment connected to a drive mechanism, each chamber further including a varistor disposed in line with its main contacts and inserted during circuit breaker opening and closing by means of two electrodes disposed outside and around the main contacts, a first electrode being electrically and mechanically connected to said varistor, the second electrode being connected to the moving equipment and being in an electrical connection with the main moving contact, wherein the second electrode is semimoving relative to the moving equipment and is diplaceable during circuit breaker opening in the opposite direction to the moving equipment.

BRIEF DESCRIPTION OF THE DRAWINGS

An embodiment of the invention is described by way of example with reference to the accompanying drawings, in which.

DETAILED DESCRIPTION

Figure 1:
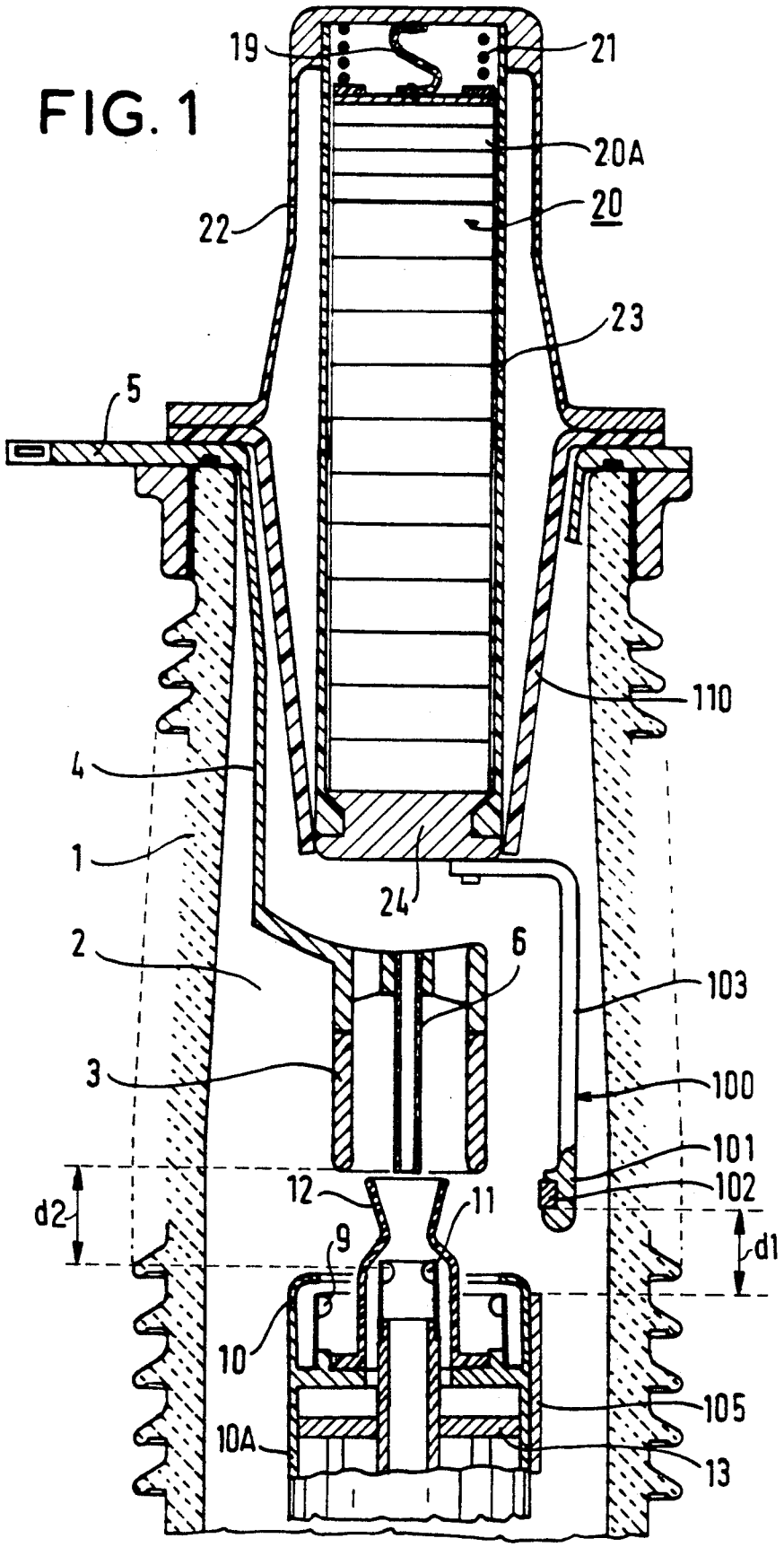
FIG. 1 is a fragmentary axial section view through a circuit breaker in which the varistor is separate from the dielectric gas, with the varistor insertion mechanism being shown diagrammatically.

In FIG. 1, reference 1 designates a cylindrical insulating case, preferably made of porcelain and delimiting an inside volume 2 which constitutes the circuit breaker interrupter chamber which is filled with a gas having high dielectric strength, e.g. sulfur hexafluoride, under a pressure of a few bars.

The circuit breaker comprises a fixed main contact 3 constituted by a tube mechanically and electrically connected by an arm 4 to a first current terminal 5 of the circuit breaker. The contact 3 is fixed to a fixed arcing contact 6 which is likewise constituted by a tubular piece. The contact 6 is electrically connected to the contact 3.

The moving equipment of the circuit breaker comprises a movable main contact 9 constituted by contact fingers protected by an anti-corona cap 10 and cooperating with the tube 3. It also comprises a movable arcing contact 11 formed by fingers 11 and cooperating with the tube defining a fixed arcing contact 6 and with a blast nozzle 12. The anti-corona cap 10 is fixed to or forms an integral portion of a metal cylindrical piece 10A which is fixed to a drive rod (not shown) and is in electrical connection via suitable contacts with a second current terminal (not shown). The circuit breaker also includes blast means including, in particular, a fixed blast piston 13. The blast means do not form a portion of the invention and are not shown in greater detail. They are implemented in conventional manner for the person skilled in the art.

The circuit breaker includes a varistor 20 placed inside the interrupting chamber. This varistor is preferably constituted by a stack of metal oxide pellets preferably of zinc oxide (ZnO). The pellets constitute a cylindrical column coaxial with the case 1. Resistive pellets 20A, represented symbolically in the drawing by a thickness different from that of the pellets 20, may be connected in series with the pellets 20 by extending the above-mentioned stack. As described below, the purpose of the resistive pellets is to limit the power dissipated in the varistor components.

The stack is compressed at the top of the chamber by means of a spring 21 which also bears against a metal cap 22 closing the chamber, which cap is electrically connected to the current terminal 5. A metal braid 19 ensures electrical continuity between the cap 22 and the stack of resistors and varistors.

The pellets are held by an insulating tube 23 which is closed at the bottom by a metal endpiece 24 which is in electrical contact with the last pellet of the stack.

The varistor insertion mechanism (which mechanism also inserts the resistor, when present) is now described.

This mechanism comprises an electrode 100 comprising a metal ring 101 (e.g. copper) having a contact finger 102. The ring 101 is held by two arms 103 fixed to the endpiece 24. Contact finger 102 rubs against a metal tubular electrode 105 fixed to the moving equipment and electrically connected to the moving contacts.

The distance d1 between the ring 102 and the electrode 105 when the circuit breaker is in the open position is more or less equal to half the distance d2 that then extends between the arcing contacts 6 and 11.

The operation of the circuit breaker is now explained, after recalling that under permanent voltage (1 p.u.) the varistor behaves like a capacitor. In high tension applications requiring a relatively large number of varistor pellets in series, the capacitance of the varistor under permanent conditions is about 30 picofarads. The capacitive current is thus extremely low.

When the circuit breaker is opened, after the main contacts 3,9 have separated, an electric arc is struck between the arcing contacts 6 and 11. Assume that the arc extinguishes before the moving equipment reaches the end of its stroke, i.e. for a mean arc duration of 12 ms (at 60 Hz) or 15 ms (at 50 Hz). During this period, contact is maintained between the pieces 105 and 101, either directly, or else via a short arc once the pieces 101 and 105 are separated. This contact has the effect of inserting the varistor in the circuit to be interrupted. If a sufficiently large surge occurs, then the varistor will operate, inserting its resistance into the circuit, thereby limiting the surge.

It may be observed that the above-mentioned arc duration corresponds to the varistor being inserted for about 15 ms. This duration is sufficient to provide effective limitation of surges, in particular when deinserting line reactances, when disconnecting unloaded lines, and when interrupting on a threephase fault, with respect to the first one of the circuit breaker poles to interrupt.

At the end of the stroke of the moving equipment, there is no longer any contact between the pieces 101 and 105, and the arc is finally interrupted.

At this instant, a large portion of the reestablished voltage is applied to the inter-electrode gap d1 (between 80% and 85% depending on the capacitance of the varistor and the capacitance between the parts 101 and 105, these two capacitances being in series).

In the open position, only a small portion of the voltage is applied to the varistor. The entire voltage is, however, applied across the inter-electrode gap d1.

The low voltage applied to the varistor when the circuit breaker is in the open position ensures that the varistor runs no risk of thermal runaway, of partial discharges, etc. . . . , as was the case for the above-described prior art series switch.

While the circuit breaker is being closed, the varistor is initially inserted in the circuit by contact between the pieces 101 and 105. Subsequent contact between the arcing contacts 6 and 11 then short circuits the varistor.

Under nominal voltage, there will be no varistor operation.

In phase opposition at 2 p.u. for example, the varistor will operate on closure.

As mentioned above, to reduce the energy in the varistor, it is possible to associate a low resistance resistor in series with the varistor.

The varistor energy is determined for a closing-opening cycle in phase opposition.

The varistor may be placed within the dielectric gas since the tube 23 is not gastight.

In the embodiment of FIG. 1, the varistor is separated from the gas of the interrupting chamber by a gastight insulating cone 110. The varistor is then placed in dry air at atmospheric pressure.

This disposition has the advantage of making it possible to replace the varistor without emptying the interrupting chamber of the sulfur hexafluoride under pressure that it contains.

Figure 4:
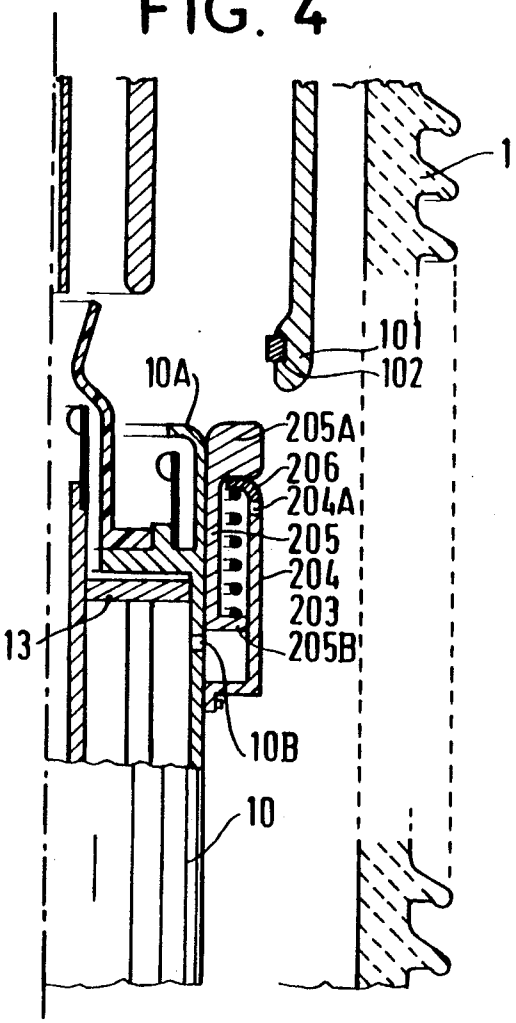
FIG. 4 is a fragmentary view of the same circuit breaker in the disengaged position.
Figure 3:
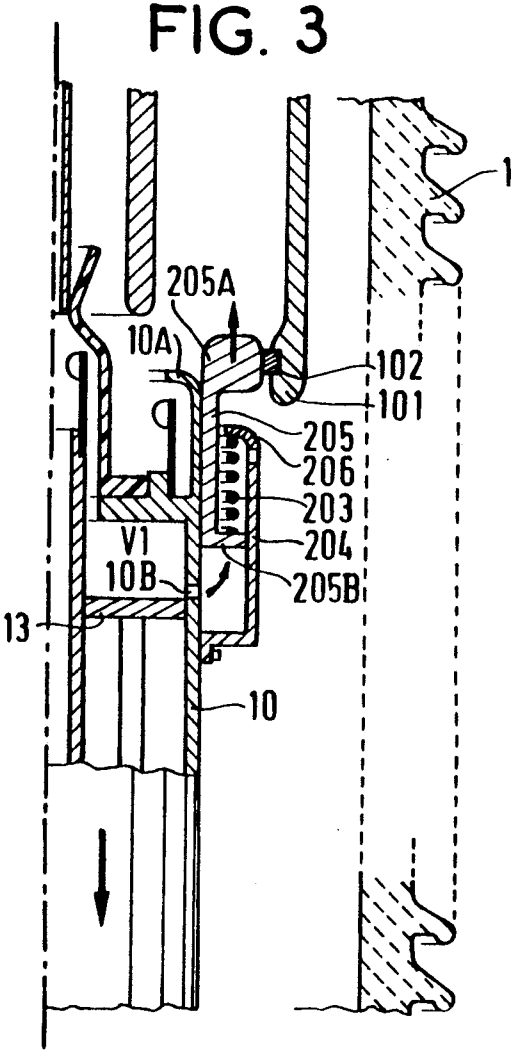
FIG. 3 is a fragmentary view of the same circuit breaker while opening.
Figure 2:
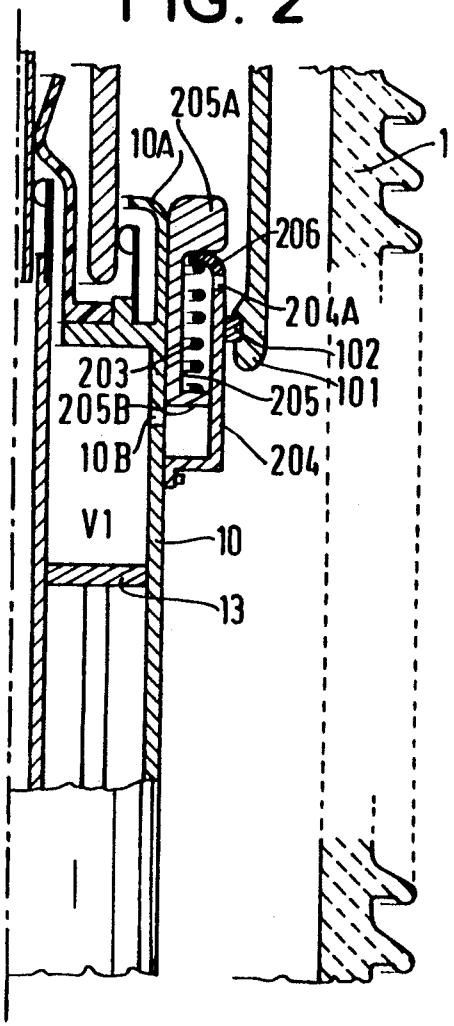
FIG. 2 is a fragmentary axial section view through a circuit breaker of the invention shown in a partially engaged position.

FIGS. 2 to 4 show the insertion mechanism of the invention as useable, in particular, when the circuit breaker has a relatively short distance d2.

The above-described tubular electrode 105 is now replaced by a tubular electrode or tube 205 around and sliding smoothly along the tube 10, 10A. At a first end, the tube 205 carries a projection 205A to establish electrical contact with the ring 102, and its opposite end it has a flange 205B constituting a bearing point for a first end of a spring 203. The spring is contained in a metal tubular piece 204 fixed at one end to the tube 10 and having a flange 206 at its other end. The second end of the spring 203 bears against the flange 206. The piece 204 is in contact with the flange 205B of the piece 205. Towards its end adjacent to the flange, the piece 204 carries holes 204A whose function is explained below. The tube 10 also carries holes 10B in the vicinity of the fixing means of the tubular piece 204 to tube 10.

When the circuit breaker is in the engaged or closed position (FIG. 2) the spring 203 is relaxed and the electrode 205 is in its low position. The electrode 102 is in contact with the tube 204 and the blast piston 13 is in its low position.

During circuit breaker opening (FIG. 3), the tube 10 moves downwards in the figure as shown by the upper arrow. The gas in the blast volume V1 is compressed and exerts pressure against the flange 205A via the hole 10B, thereby causing the electrode 205 to move in the opposite direction as shown by the upper arrow against the spring 203 which is compressed. The displacement of the electrode 205 is also assisted by the acceleration of the moving contact towards the open position. The holes 204A serve to evacuate gas from the volume lying between the tubes 204 and 205, thus making it possible to avoid increasing the drive energy excessively. By virtue of this movement of the electrode 205 in the opposite direction to the moving of the moving equipment, the varistor is inserted for sufficient duration, with the electrode 102 initially being in electrical contact with the tube 204 and then with the projection 205A.

After the circuit breaker has opened completely (FIG. 4), the piston 13 has gone past the holes 10B. The extra pressure acting on the flange 205B disappears, the spring 203 expands, returning the electrode 205 to its initial position, and thereby making it possible to maintain a sufficient insulation distance.

On closing, the electrode 205 is pressed against the flange 206 by the acceleration of the moving contact and by the suction set up in the volume V1.

In some cases, it is advantageous to provide the electrode 205 in the form of a metal rod sliding inside a small diameter tube stuck to the tube 10. This disposition makes it possible to have a volume of compressed gas beneath the electrode 205 which is small.

The sequences in circuit breaker operations of FIGS. 2 to 4 illustrate the ease in the invention by minimal modification of existing circuit breakers, even if the distance between their contacts in the circuit breaker open position is small.

The invention is applicable to high tension circuit breakers, both conventional circuit breakers and metal-clad circuit breakers.

We claim:

1. A high tension circuit breaker insulated by gas having good dielectric properties, said circuit breaker comprising a cylindrical insulating case forming at least one interrupting chamber per phase, each chamber housing a fixed main contact connected to a first current terminal and a movable main contact in electrical connection with a second current terminal and constituting a portion of moving equipment connected to a drive mechanism, each chamber further including a varistor disposed in line with said main contacts and insertable during circuit breaker opening and closing by means of two electrodes disposed outside and around the main contacts, consisting of a first electrode electrically and mechanically connected to said varistor, and a second electrode connected to said moving equipment and being in electrical connection with said movable main contact, and means for mounting said second electrode relative to said moving equipment for limited movement and means for displacing said second electrode during circuit breaker opening in a opposite direction to that of said moving equipment.

2. A circuit breaker according to claim 1, wherein said means for displacing said second electrode comprises means responsive to compression of the blast gas of the circuit breaker, and said circuit breaker further comprising a spring interposed between said moving equipment and said second electrode for biasing said second electrode in the direction of movement of said moving equipment for returning said second electrode to an initial position at the end of the circuit breaker opening operation.

3. A circuit breaker according to claim 2, wherein said second electrode comprises a tube concentrically mounted about a tube of said moving equipment and having a first end proximate to said first electrode carrying a projection to establish electrical contact with said first electrode, and having a flange at a second opposite end projecting radially outwardly of said moving equipment tube, a metal tubular piece fixed at one end to said tube of said moving equipment and movable therewith, and having a radially inwardly projecting flange at a second opposite end thereof, a compression coil spring interposed between said flanges, and positioned concentrically about said second tubular electrode, said circuit breaker including a fixed blast piston internally of said moving equipment tube and partially defining with said moving equipment tube a blast volume internally of said moving equipment tube, at least one radial hole within said moving equipment tube, and opening to a chamber defined by said metal tubular piece, said second tubular electrode, said moving equipment tube, and said flange of said second movable tubular electrode, whereby during opening of the circuit breaker, gas in the blast volume is compressed and passes via said at least one hole into said chamber and exerts pressure against the second tubular electrode flange, thereby causing the second electrode to move in the opposite direction against the bias of the compression spring to increase the time of insertion of the varistor during circuit breaker opening operation.

4. The circuit breaker according to claim 3, wherein said metal tubular piece comprises at least one radial hole therein proximate to the flange of said metal tubular piece at said one end, to evacuate gas from a volume between the second tubular electrode and said metal tubular piece, thereby avoiding excessive increase in drive energy during movement of the second electrode in a direction opposite that of said moving equipment tube.

5. A circuit breaker according to claim 1, wherein said cylindrical insulating case further comprises a gas-tight insulator cone enclosing the varistor, and said cylindrical insulating case is filled with gas having good dielectric properties, under pressure.

6. A circuit breaker according to claim 5, wherein said cone is filled with dry air under atmospheric pressure.

7. A circuit breaker according to claim 1, further comprising a resistor having low resistance, and means for mounting said low resistance resistor in series with the varistor in a common case internally of said cylindrical insulating case.

* * * * *